US006906460B2

(12) United States Patent
Busai et al.

(10) Patent No.: US 6,906,460 B2
(45) Date of Patent: Jun. 14, 2005

(54) DEVICE AND METHOD FOR RETAINING MERCURY SOURCE IN LOW-PRESSURE DISCHARGE LAMPS

(75) Inventors: Gyula Busai, Budapest (HU); Norbert Benkö , Tiszaujvaros (HU)

(73) Assignee: General Electric Company, Schenectady, NY (US)

( * ) Notice: Subject to any disclaimer, the term of this patent is extended or adjusted under 35 U.S.C. 154(b) by 243 days.

(21) Appl. No.: 10/064,149

(22) Filed: Jun. 14, 2002

(65) Prior Publication Data

US 2003/0230979 A1 Dec. 18, 2003

(51) Int. Cl.[7] ..... H01J 17/26; H05B 41/16
(52) U.S. Cl. ..... 313/565; 315/248
(58) Field of Search ..... 313/565, 566, 313/318.1, 318.09, 493, 634; 315/57, 58, 59, 248, 344

(56) References Cited

U.S. PATENT DOCUMENTS 600,211 A * 3/1898 Luger ..... 204/221
5,434,482 A 7/1995 Borowiec et al. ..... 315/248
5,629,584 A 5/1997 Borowiec et al. ..... 313/565
5,751,110 A * 5/1998 Spaapen et al. ..... 313/550
5,912,536 A * 6/1999 Michiels et al. ..... 315/248
6,137,236 A * 10/2000 Michiels et al. ..... 315/248
6,201,347 B1 3/2001 Smulders

* cited by examiner

*Primary Examiner*—Wilson Lee
*Assistant Examiner*—Minh Dieu A
(74) *Attorney, Agent, or Firm*—Fay, Sharpe, Fagan, Minnich & McKee, LLP

(57) ABSTRACT

A device for retaining a mercury source in the discharge space of a low-pressure discharge lamp is disclosed. The mercury source retaining device comprises a holder, which has an inner space communicating with the discharge space and a receiver opening for receiving a mercury source. The retaining device further comprises resilient clamping means for clamping the holder in a tubular space segment of the discharge space and resilient retaining means at least partially blocking the receiver opening. The resilient retaining means are adapted for allowing a passage of the mercury source in a direction towards the inner space of the holder, but block the movement of the mercury source through the receiver opening in a direction out of the holder.

19 Claims, 7 Drawing Sheets

DEVICE AND METHOD FOR RETAINING MERCURY SOURCE IN LOW-PRESSURE DISCHARGE LAMPS

BACKGROUND OF INVENTION

This invention relates to a device and a method for retaining a mercury source in the discharge space of a low-pressure discharge lamp. The invention also relates to a lamp equipped with the device.

A wide variety of low-pressure discharge lamps are known in the art. These lamps contain small doses of mercury, which radiates under the influence of the discharge arc. The mercury may be introduced into the discharge space of the lamp in a number of ways. One possible method is the introduction of an amalgam, typically containing bismuth, e.g. a BiIn or BiSnPb compound. The mercury vapour necessary for the operation of the lamp is released from the amalgam. The amalgam is optimally positioned near a cold spot of the lamp, for example near a tip of the discharge tube. Another method uses a so-called pellet, which contains liquid mercury. The mercury is released from the pellet after the sealing of the discharge space with the help of a heat treatment of the pellet. Both an amalgam or a pellet must be prevented from rolling freely about in the discharge space, as it may collide with the electrodes and it could scratch off the light emitting layer from the internal surface of the discharge vessel.

A known method to position the amalgam is to insert it into an exhaust tube of the discharge vessel. The amalgam is then held in a predetermined location with various methods. In the method disclosed in U.S. Pat. Nos. 5,629,584 and 5,434,482, the amalgam is held in place with indentations on the exhaust tube and glass balls before and after the amalgam. However, this structure has certain disadvantages. The tube section of the discharge vessel must be held in a vertical position, otherwise the glass balls and the amalgam will not remain in the desired location during the so-called tip-off, i.e. when the exhaust tube of the lamp is sealed and the remaining excess length of the tube is removed. In certain production lines, this is not always feasible, and there is a need for an amalgam retaining method where the amalgam is held in place irrespective of the orientation of the tube, which receives the amalgam.

A discharge lamp with an amalgam container is disclosed in U.S. Pat. No. 6,201,347. In this known discharge lamp, the container is held in place with the help of a resilient, coiled wire, which is attached to the container with the amalgam. The container and the coiled wire are pushed into a tube within the discharge space of the discharge lamp. The coiled wire acts as a clamping means, which substantially prevents the movement of the container within the tube.

Another discharge lamp with an amalgam container is disclosed in U.S. Pat. No. 6,137,236. In this known discharge lamp the container is held in place with the help of a resilient body, which surrounds the container with the amalgam. The resilient body is provided with radially extending portions, which press against a wall of a tube within the discharge space of the lamp. The extending portions of the resilient body keep the container in a predetermined location within the tube. When the container is not inserted in the resilient body, the radially extending portions of the body are somewhat retracted, and the resilient body may be inserted into the tube with ease. The extending portions spread when the container is pushed into the resilient body.

Though the retaining methods disclosed in U.S. Pat. Nos. 6,137,236 and 6,201,347 are practicable in any orientation of the discharge vessel, other problems remain. For various reasons, it is desirable to insert the mercury source into the discharge space only after an evacuation of the discharge vessel, and only shortly before the final sealing of the discharge vessel. However, the containers with the amalgam, as disclosed in U.S. Pat. Nos. 6,137,236 and 6,201,347, require relatively complicated equipment, if the containers must be fed into the tube in the evacuated state of the tube. Further, the containers need to be inserted into the tube in a predetermined position (orientation) relative to the tube. This requires further specialised positioning means in the feeding equipment, which must operate in vacuum. Such an equipment is complicated, hence expensive[007] Therefore, there is a need for a method for retaining a mercury source, which allows the insertion of the mercury source into the discharge space in vacuum, and which does not require complicated manufacturing facilities, and which may be integrated into all types of existing production lines in a simple manner.

SUMMARY OF INVENTION

In an exemplary embodiment of the present invention, a device for retaining a mercury source in the discharge space of a low-pressure discharge lamp comprises a holder with an inner space. The inner space of the holder is in communication with the discharge space. The holder further comprises a receiver opening for receiving a mercury source, and resilient clamping means for clamping the holder in a tubular space segment of the discharge space. The holder also comprises resilient retaining means. The function of the resilient retaining means is to block the receiver opening, at least partially. The retaining means are adapted for allowing a passage of the mercury source in a direction towards the inner space of the holder, and blocking the movement of the mercury source through the receiver opening in a direction out of the holder.

In an exemplary embodiment of another aspect of the invention, a method for retaining a mercury source at a predetermined location in a discharge space of a low-pressure discharge lamp is provided. In this method, a retaining device as described above is inserted into the discharge space of the discharge lamp. The retaining device is clamped at the predetermined location in the discharge space. This is followed by the insertion of the mercury source into the holder through the receiver opening and past the retaining means.

In an embodiment of still another aspect of the invention, a low-pressure discharge lamp comprises a discharge space, a discharge electrode and a mercury source located in a predetermined location of the discharge space. In the lamp, the mercury source is retained in a retaining device as described above.

The resilient retaining means of the retaining device makes it possible to insert the retaining device into the discharge space in an early stage of the production, while the mercury source itself may be fed into the retaining device in the very last moment before the discharge space is sealed. In this manner, no or a negligible amount of mercury vapour escapes from the discharge vessel during production, and mercury contamination of the production equipment remains low.

As a further important advantage, the suggested retaining device remains in its position—practically in an exhaust tube of the discharge vessel—, in an arbitrary orientation of the exhaust tube. This advantage may be exploited especially at horizontal manufacturing of linear fluorescent lamps, which in turn results in increased productivity of the manufacture.

BRIEF DESCRIPTION OF DRAWINGS

The invention will now be described with reference to the enclosed drawings where.

DETAILED DESCRIPTION

Figure 1:
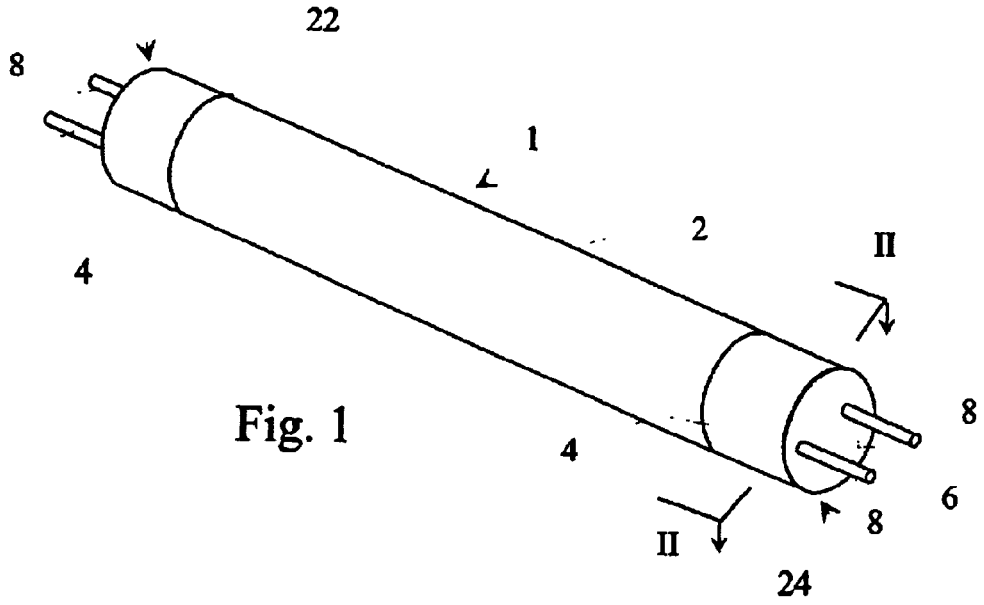
FIG. 1 is a perspective view of a low-pressure discharge tube manufactured according to the method.
Figure 2:
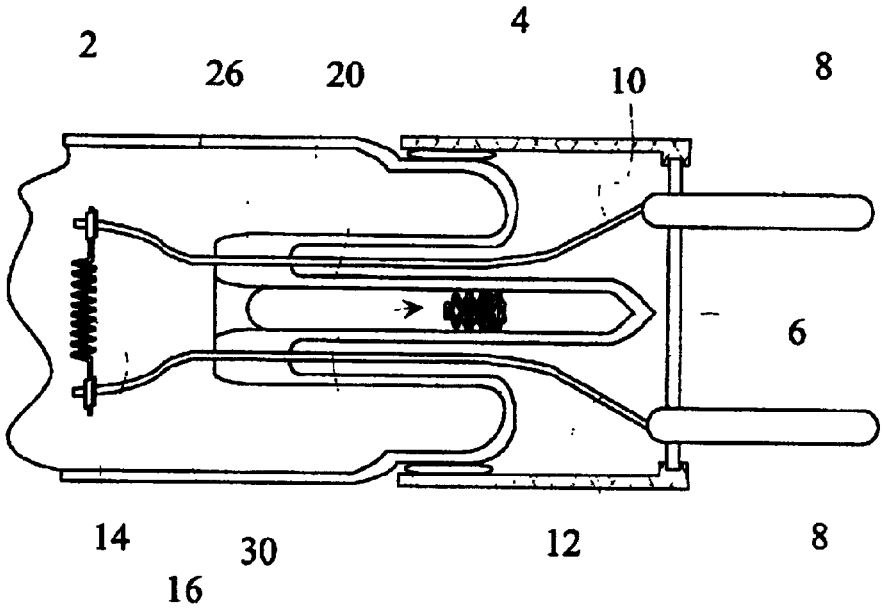
FIG. 2 is an enlarged cross section of an end portion of the lamp shown in FIG. 1, with an embedded electrode assembly, taken along the plane II—II of FIG. 1.
Figure 3:
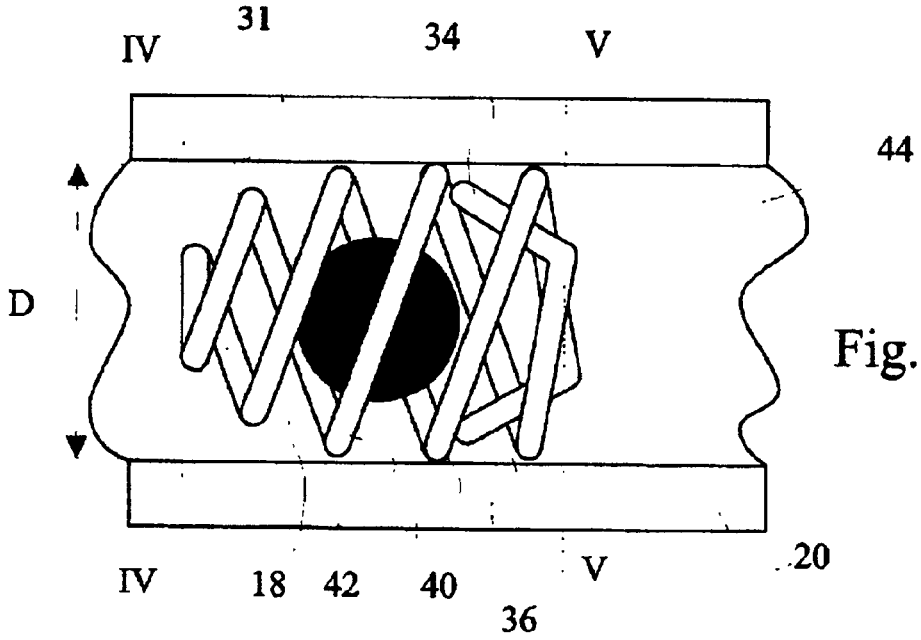
FIG. 3 is an enlarged view of an exhaust tube in the end portion shown in FIG. 2, with the inserted retaining device and the mercury source within the retaining device.
Figure 4:
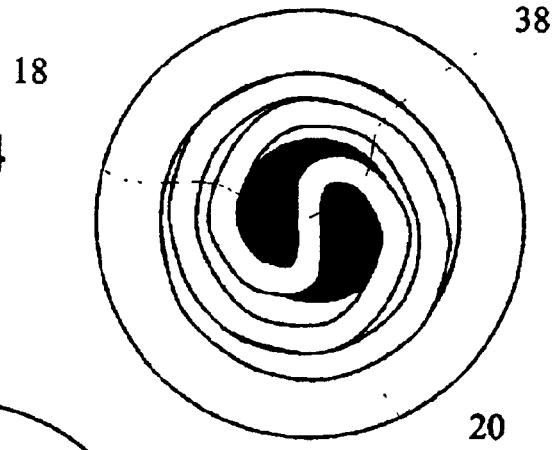
FIG. 4 is a cross section of the exhaust tube and a top view of the retaining device, seen in the plane IV—IV in FIG. 3.

Referring now to FIGS. 1 to 3, there is shown a low-pressure discharge lamp 1 in the form of a straight light tube. The lamp 1 has a sealed discharge vessel 2. A cap 4 covers the ends 22 and 24 of the discharge vessel 2, and also holds the electric contacts 8 of the lamp. The contacts 8 are mechanically supported by an insulating plate 6, which latter is embedded in the cap 4. The contacts 8 are welded to the ends of lead-through wires 10 and 12. The wires 10,12 connect to a filament 14.

The discharge vessel 2 of the low-pressure discharge lamp 1 encloses a discharge space 16. The filament 14 functions as a discharge electrode, which is located in the discharge space 16. For the proper operation of the discharge lamp 1, a mercury source 18 is also provided in the discharge space 16. In the shown embodiment, the mercury source 18 is an amalgam, for example made of a BilnPb compound, which is capable of forming an amalgam alloy with mercury.

The mercury source 18 is located in a predetermined location of the discharge space 16. In the shown embodiment, the mercury source 18 is located in an end of an exhaust tube 20. The exhaust tube 20 connects to a stem 26 supporting the discharge electrode, i. e. the filament 14. This arrangement of the stem 26 and the exhaust tube 20 at the ends of the discharge vessel 2 is well known in the art, and needs no further explanation.

In order to retain the mercury source 18 in the predetermined location of the discharge space 16, the discharge lamp 1 comprises a retaining device 30, which will be explained in detail below. The mercury source 18 is retained in the retaining device 30, and in this manner it permanently remains in the predetermined location.

In the embodiment shown in FIGS. 3 to 6, the retaining device 30 is made as double wire coil 31 as best seen in FIG. 3. The central windings and the ends of the coil 31 act as a holder, which surrounds the mercury source 18. In this manner the holder of the retaining device 30 comprises an inner space, which communicates with the discharge space 16. This is necessary to allow an unhindered passage of the mercury vapours from the mercury source 18 into the discharge space 16.

Figure 5:
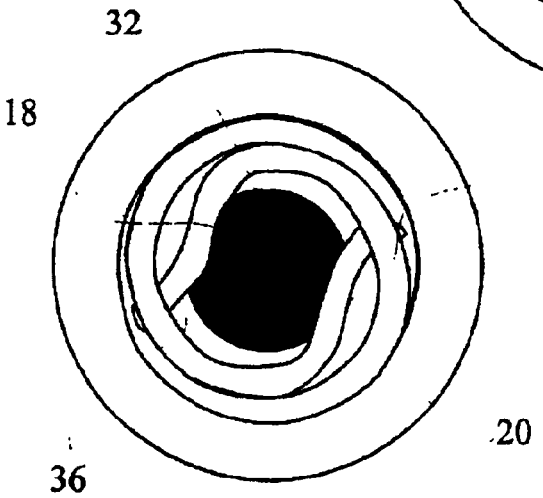
FIG. 5 is another cross section of the exhaust tube and a bottom view of the retaining device, seen in the plane V—V in FIG. 3.
Figure 6:
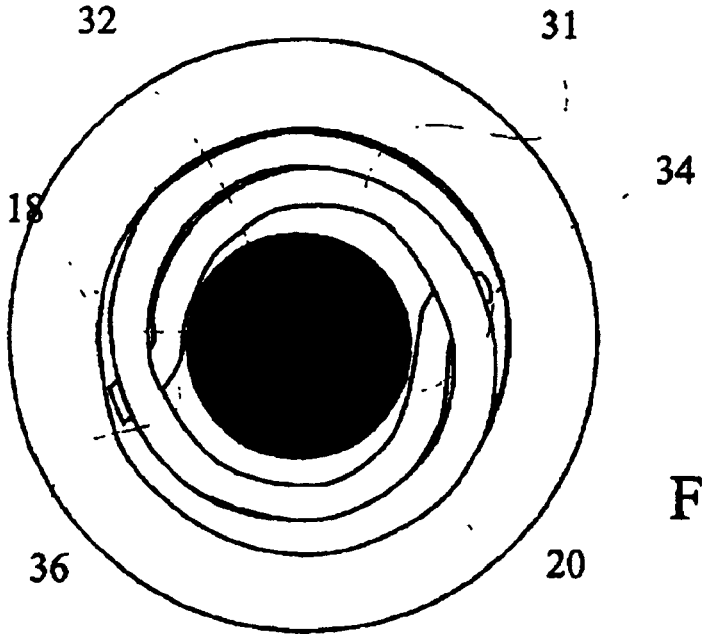
FIG. 6 illustrates a ball-formed mercury source being inserted in the retaining device in a view similar to FIG. 6.
Figure 12:
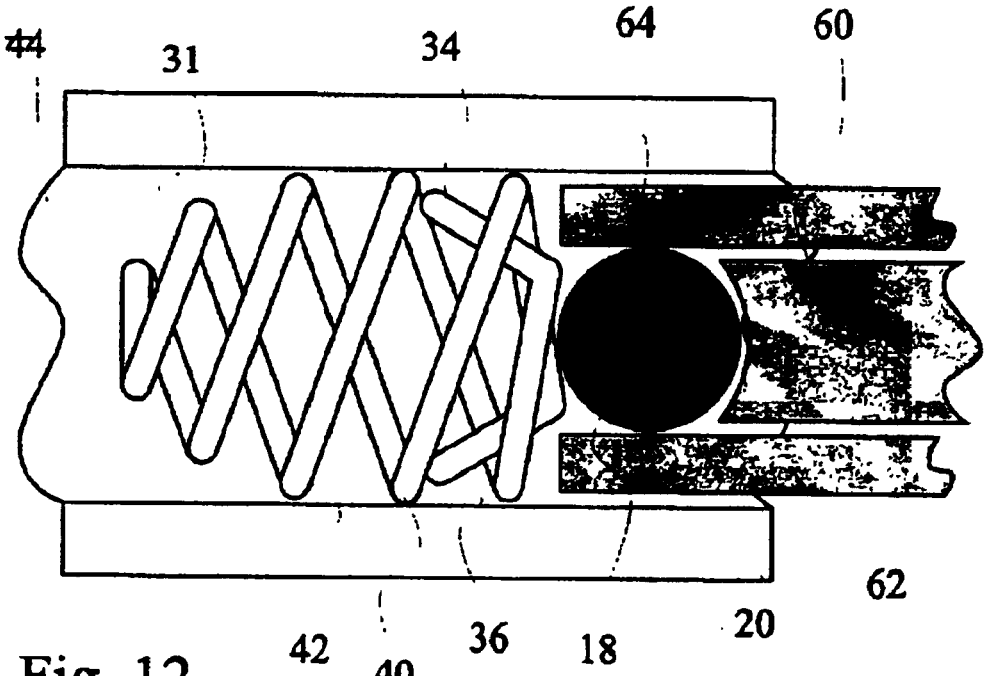
FIG. 12 illustrates a first step during the insertion of a mercury source into the retaining device, in partial cross-section.
Figure 13:
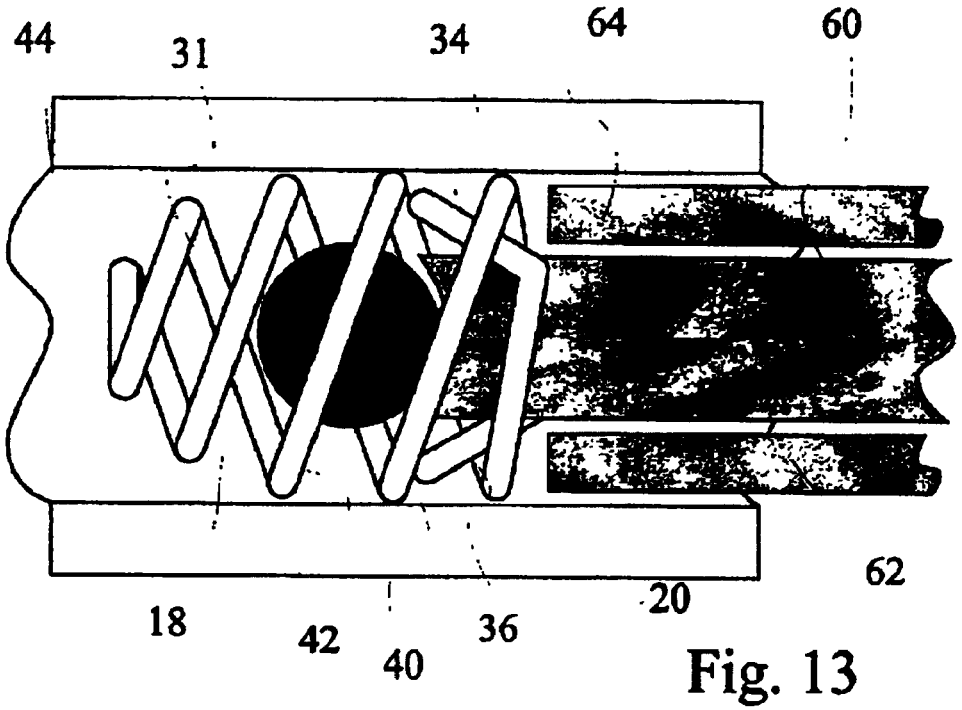
FIG. 13 illustrates a subsequent step in the insertion of a mercury source into the retaining device, following the step shown in FIG. 12.
Figure 14:
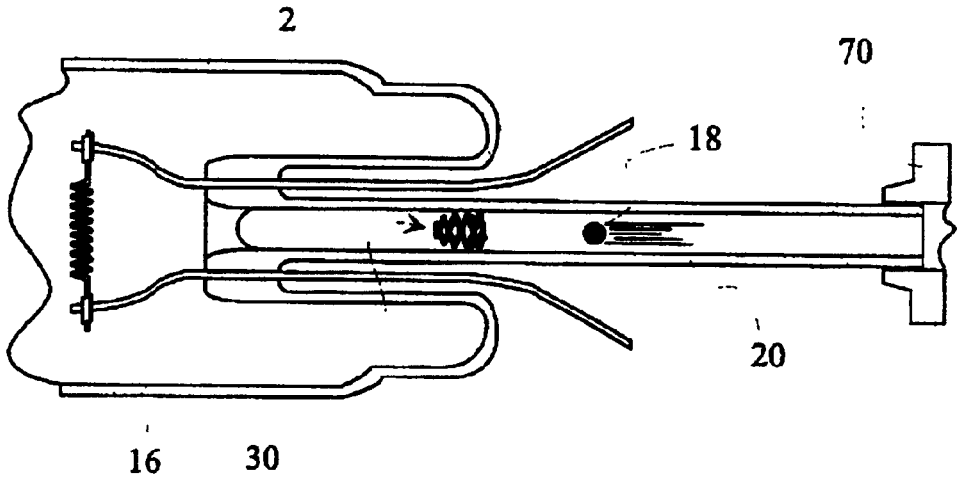
FIG. 14 illustrates another insertion method for the insertion of the mercury source into the retaining device.

The holder of the mercury source 18 also has a receiver opening 32 for receiving the mercury source 18 as will be explained with reference to FIGS. 12 to 14. In the embodiment shown in FIGS. 3 to 5, the receiver opening 32 is defined as the opening surrounded by the last windings and the two ends 34,36 of the coil 31. The receiver opening 32 is best seen in FIG. 6, which shows the retaining device 30 from the ends 34,36 of the coil 31. As it is apparent from FIG. 5, the distance between the ends 34,36 of the coil 31 are only slightly smaller than the diameter of the ball-shaped mercury source 18. As a comparison, the tip 38 of the coil 31, where the two strands of the coil 31 are joined, substantially closes the inner space in the holder of the retaining device 30, and prevents any passage of the mercury source 18 between the windings of the coil 31.

The retaining device 30 is equipped with resilient clamping means. These serve to clamp the mercury source holder in a tubular space segment of the discharge space, typically in the exhaust tube 20 as shown in FIGS. 2 and 3. In the embodiment where the retaining device 30 is made as the double coil 31, the central windings 40,42 of the coil 31 act as the resilient clamping means. In the non-stressed state of the coil 31, the external diameter of the central windings 40,42 is slightly larger than the internal diameter D of the exhaust tube 20. In this manner, when the coil 31 is inserted into the exhaust tube 20, the central windings 40,42 are compressed, and press against the internal surface 44 of the exhaust tube 20. Due to the friction between the coil 31 and the wall of the exhaust tube 20, the retaining device 30 remains at the location where it has been inserted.

The retaining device 30 is further equipped with resilient retaining means. In the embodiment shown in FIGS. 3 to 6, the retaining means is embodied by the ends 34 and 36 of the coil 31. The ends 34 and 36 are folded back, so they partly turn towards a central axis of the coil 31. In this manner, the retaining means, i.e. the ends 34 and 36 are at least partially blocking the receiver opening 32, as best seen in FIG. 5. The retaining means are adapted for allowing a passage of the mercury source 18 in a direction towards the inner space of the holder. At the same time, the retaining means are blocking the movement of the mercury source 18 through the receiver opening 32 in a direction out of the holder. In the embodiment shown in FIGS. 3 to 6, this works as follows: the flexible resistance of the ends 34,36 is relatively easily surmounted, and the ends 34,36 yield to the external force and spread, when the mercury source 18 is pushed in the inner space of the retaining means 30 between the two ends 34,36 of the coil. This is shown in FIG. 6, which shows the ends 34, 36 as they spread while the mercury source 18 passes between them. However, when the mercury source 18 would move out of the retaining device 30, for example under the force of gravity, or because of its inertia, the retaining means, i. e. the folded ends 34, 36 of the coil 31 show sufficient resistance for preventing the movement of the mercury source 18 out of the inner space of the retaining device 30. It is assumed that the mercury source 18 inserted into the retaining device 30 is itself not capable of exerting a force that is large enough to press it again out from the retaining device 30.

In the embodiment shown in FIGS. 3 to 6, the retaining device 30 is made of resilient wire material, typically made of stainless steel, molybdenum, tungsten or nickel. As explained above, in this case the mercury source holder of the retaining device is constituted by the double coil 31 itself, where the ends 34,36 of the coil are folded back, and turned at least partly towards a central axis of the coil 31. In this manner, the ends 34,36 act as the retaining means of the retaining device 30 embodied by the coil 31.

Figure 7:
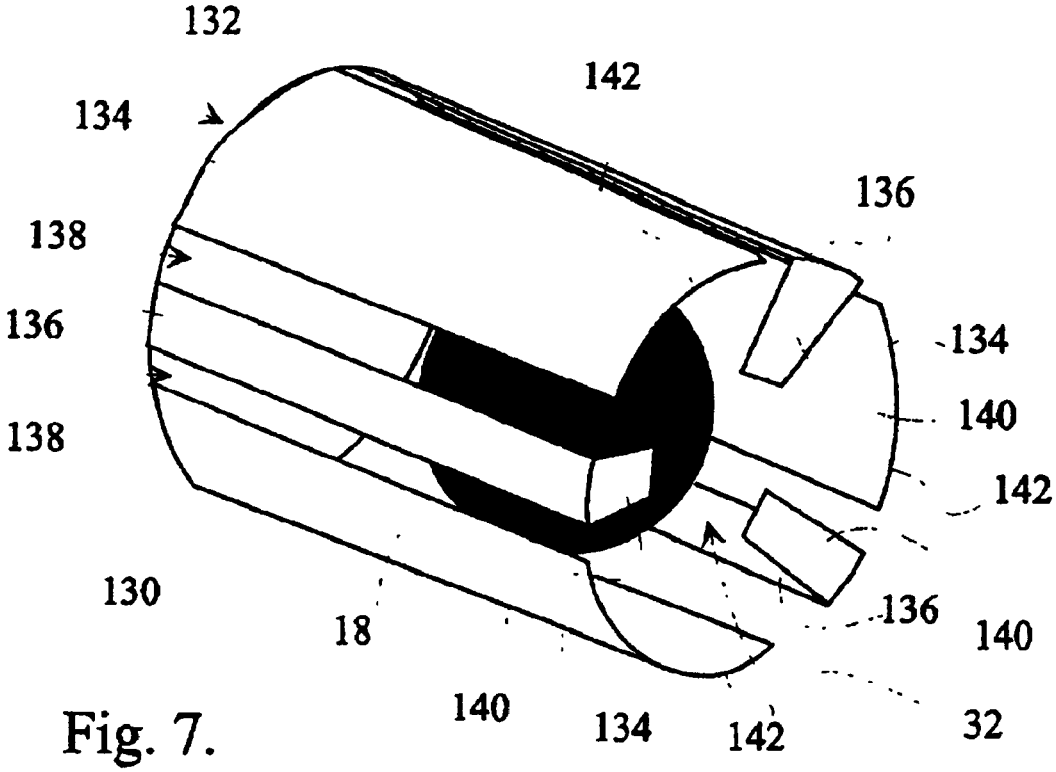
FIG. 7 is a perspective view of another embodiment of the retaining device.
Figure 8:
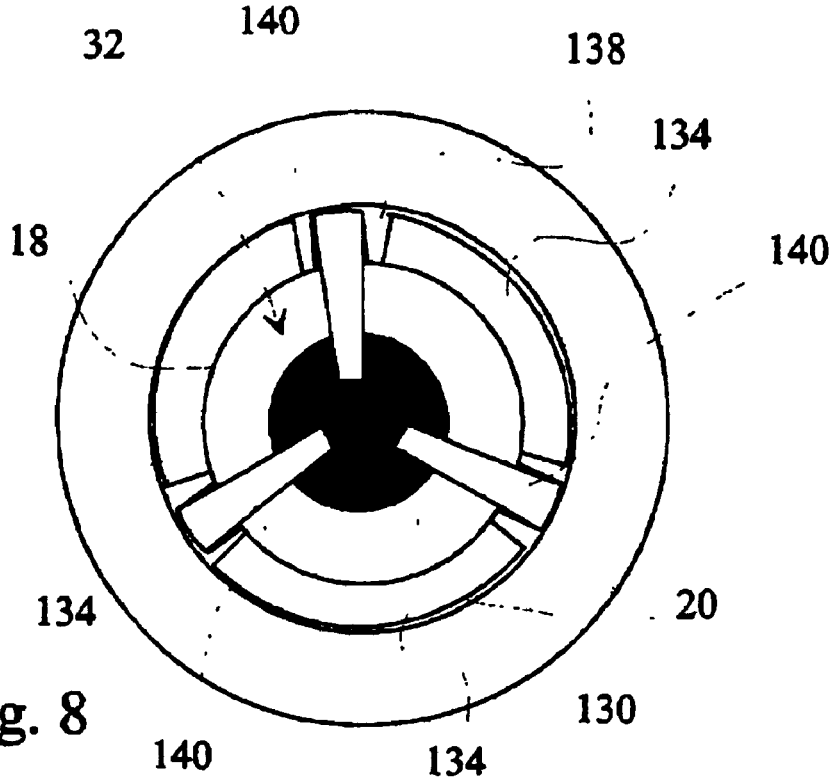
FIG. 8 shows a cross-section of the exhaust tube with the retaining device of FIG. 7 being inserted, in a view similar to FIG. 6.

Another embodiment of the retaining device 30 is shown in FIGS. 7 and 8. This retaining device 30 also comprises a holder part with an inner space and receiver opening, resilient clamping means for clamping the holder in a tube of the discharge space 16, and resilient retaining means at least partially blocking the receiver opening.

In the retaining device 30 of FIG. 7 and 8, the mercury source holder is a substantially cylindrical capsule 130. The capsule 130 is made of a sheet material formed in an essentially cylindrical shape. In order to facilitate the insertion of the retaining device 30, i. e. the capsule 130 into the exhaust tube 20, the external diameter of the capsule 130 at the closed end 132 is positively smaller than the internal diameter D of the exhaust tube 20. As best seen in FIG. 7, the cylindrical holder of the capsule 130 comprises cylinder segments 134 and 136. In the shown embodiment, one cylinders segments 134 are relatively wide, while other segments 136 are somewhat narrower. The cylinder segments 134,136 are separated with slits 138. The slits 138 are substantially parallel with a central axis of the cylinder.

In the embodiment shown in FIGS. 7 and 8, the clamping means of the retaining device 30 is constituted by the wide cylinder segments 134. In the non-stressed state of the capsule 130, the segments 134 are tilting radially outward. When the capsule 130 is inserted into the exhaust tube 20, the segments 134 press against the internal surface of the exhaust tube 20, and thereby hold the capsule 130 in place.

At the same time, the resilient mercury source retaining means of the capsule 130 are constituted by the free ends 140 of the narrow cylinder segments 136. These free ends 140 are folding radially inward, toward a central axis of the capsule 130. In this manner the receiver opening 32 of the mercury source holder is surrounded by the free edges 142 of the cylinder segments 134, and the ends 140 protrude into the receiver opening 32, at least partly blocking it. The ends 140 of the segments 134 are folded slightly towards the inner space of the capsule 130, and the ends 140 also act as resilient retaining means which are adapted for allowing a passage of the mercury source 18 through the receiver opening 32 in a direction towards the inner space of the holder. At the same time, the ends 140 are capable of blocking the movement of the mercury source 18 through the receiver opening in a direction out of the capsule 130.

Similarly to the coil 31, the capsule 130 may be manufactured of stainless steel, molybdenum, tungsten, nickel, or any other material which is suitably resilient, and which does not destroy the discharge atmosphere in the discharge space 16.

Figure 9:
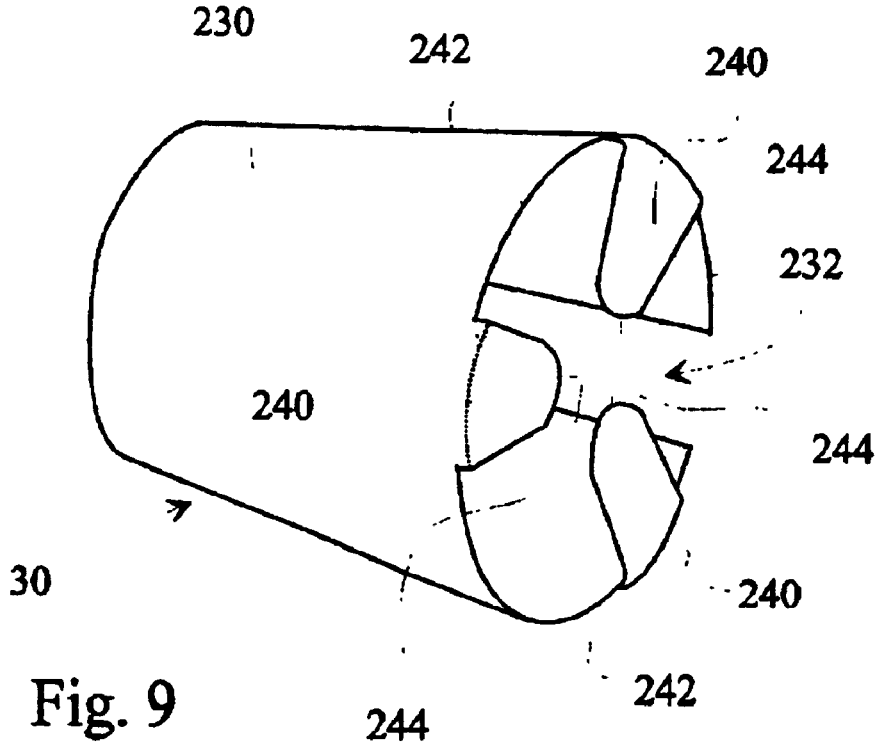
FIG. 9 is a perspective view of yet another embodiment of the retaining device.

Another embodiment of the mercury source retaining device 30 is shown in FIG. 9. Here, the mercury source holding part of the retaining device 30 is formed as a substantially frusto-conical barrel 230. As with the capsule 130, the retaining device 30 constituted by the barrel 230 is made of a resilient sheet material. The clamping of the barrel 230 in the tubular segment of the discharge space 16 is ensured by the flexibility of the external shell of the barrel 230. A longitudinal slit 232 is formed substantially along a generatrix of the barrel 230, which means that the circumference and thereby the diameter of the barrel 230 may decrease when the barrel 230 is inserted into the exhaust tube 20 of the discharge vessel 2.

The retaining means of the retaining device 30 constituted by the barrel 230 are formed as tongues 240. The tongues 240 extend radially inwards from an edge 242 of the barrel 230, substantially towards the principal central axis of the barrel 230. The tongues 240 function substantially in the same manner as the folded ends 140 of the segments 134 of the capsule 130. This means that the receiver opening 32 of the barrel 230 is defined by the surrounding edge 242, and this receiver opening 32 is partly blocked by the tongues 240, because the diameter of an included circle between the tips 244 of the tongues 240 is smaller then the external diameter of a ball-shaped mercury source 18 (not shown in FIG. 9). However, the tongues 240 also yield to an external pressing force when a ball-shaped mercury source 18 is pressed into the inner space of the barrel 230 between the tongues 240.

The mercury source retaining device 30 is suitable for retaining a mercury source 18 at a predetermined location in the discharge space 16 of the low-pressure discharge lamp 1. The method, in which the retaining device 30 is used, is explained with reference to FIGS. 10 to 15. These illustrate the use of a retaining device 30 formed as a double-ended coil 31, but the other embodiments of the retaining device 30 are used in a similar manner.

Figure 10:
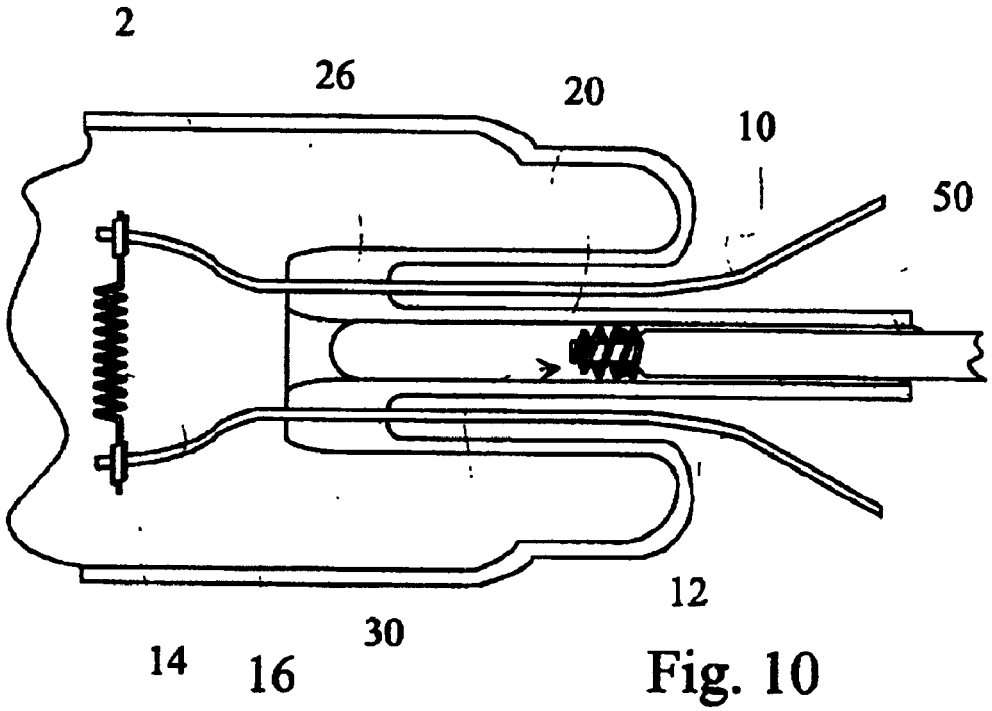
FIG. 10 illustrates the insertion of the retaining device into the exhaust tube of the discharge lamp.
Figure 11:
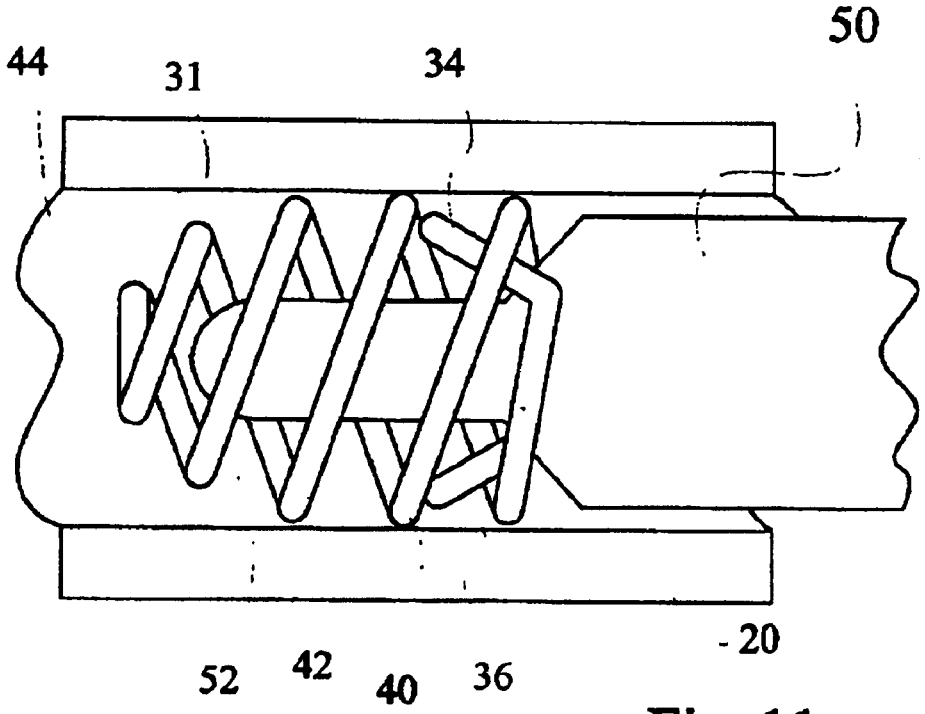
FIG. 11 is an enlarged view of a part of FIG. 10.

In a first step, as shown in FIG. 10, the retaining device 30 is inserted into the discharge space 16. More precisely, the retaining device 30 is inserted into its final position, in the shown embodiment into that end of the exhaust tube 20, which is closer to the stem 26 holding the filament 14. In this manner, the mercury source 18 is located in a relatively cold place, which is sufficiently far from the discharge arc and also far from the thermal load which arises when the other end of the exhaust tube 20 is sealed.

The retaining device 30 is pushed into the exhaust tube 20 by a suitably formed tool, e.g. a rod 50 with a positioning pin 52 at the end thereof. The diameter of the rod 50 and that of the pin 52 is selected to ensure a loose fit in the exhaust tube 20 and in the retaining device 30 during insertion. In this manner the rod 50 is easily withdrawn from the exhaust tube 20 and also from the retaining device 30, while the latter remains in the exhaust tube. As the retaining device 30 is inserted, the wall of the exhaust tube 20 slightly compresses the windings 40 and 42 of the coil 31. If necessary, the rod 50 and the coil 31 may be rotated during insertion in order to make the compression of the coil 31 even easier (in the shown embodiment the rotation is counter-clockwise). For this purpose, the rod 50 may comprise suitable extensions to cause the simultaneous rotation of the coil 31. Thereby the coil is "screwed" into the exhaust tube.

The retaining device 30 is pushed into the exhaust tube 20 in a position where the receiver opening 32 of the retaining device 30 turns towards an outer end of the exhaust tube 20. This means that in the shown embodiment, the receiver opening 32 is to the right, and the positioning pin 52 of the pushing rod is inserted into the retaining device 30 through the receiver opening 32. When retaining devices in the form of the capsule 130 or the barrel 230 are to be inserted, the positioning pin 52 may comprise suitable grooves, which loosely receive the ends 140 of the segments 134 or the tongues 240, without positively engaging those. In this manner the rod 52 may be withdrawn, without pulling out the capsule 130 or the barrel 230 from the exhaust tube 20 while the retaining device 30 is clamped at the predetermined location of the discharge space 16.

Advantageously, the retaining device 30 is inserted in the discharge space 16 before the discharge space 16 is evacuated. This means that the equipment, which feeds the retaining devices 30 into the production line and onto the rod 50, need not be in vacuum. This makes the feeding and positioning of the retaining devices 30 easier.

Following the insertion of the retaining device 30, the mercury source 18 is inserted into the holder of the retaining means 30. The mercury source 18 is inserted through the receiver opening 32 and past the retaining means, i. e. past the ends 34, 36 of the coil 31 in the shown embodiment. This may also take place before evacuation, but it is preferred to insert the mercury source 18 in the holder of the retaining device 30 after evacuating the discharge space. Thereby the emission of mercury vapours into the ambient atmosphere is minimized.

The mercury source 18 may be pushed through the receiver opening 32 of the retaining device 30 with another, suitably formed pushing rod 60. For the sake of proper positioning and feeding of the mercury source 18, the pushing rod 60 may comprise an external sheath or sleeve 62, the end 64 of which snugly receives the ball-shaped mercury source 18. The sleeve 62 and the rod 60 are pushed until the unit reaches the retaining device 30. Thereafter the rod 60 pushes the mercury source 18 out from the end 64 of the sleeve 62, and into the retaining device 30 through its receiver opening 32.

In another version of the method, the mercury source insertion process utilises the energy of a filling gas, such as argon. After evacuation of the discharge vessel 2, which is symbolised with the flange 70 of the evacuating equipment, the filling gas is fed into the discharge space 16 before the latter is sealed. The mercury source 18 is inserted into the input end of the exhaust tube 20, and thereafter the mercury source 18 is blown through the receiver opening 32 with the filling gas. This is illustrated in FIG. 14. For this purpose, the mercury source 18 needs to develop sufficient inertia to surmount the resistance of the resilient retaining means, which block the receiver opening 32.

Figure 15:
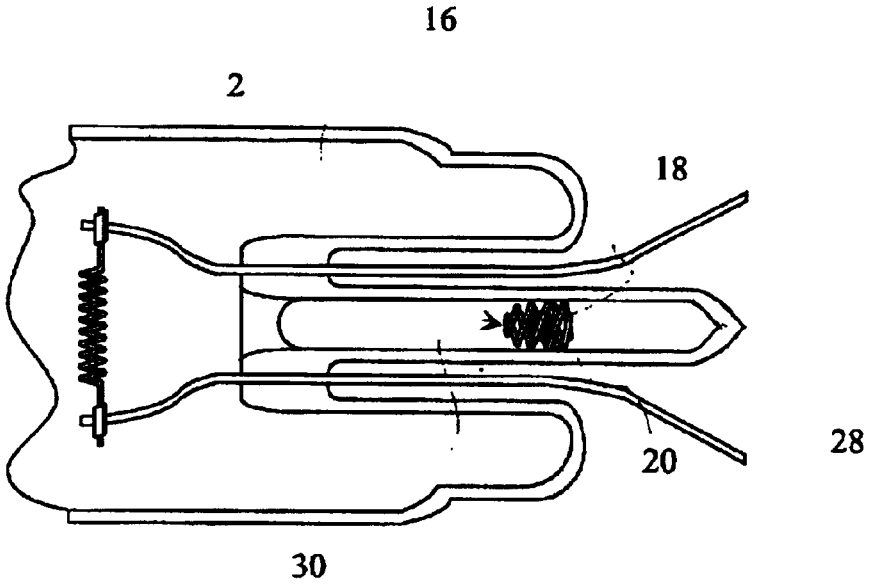
FIG. 15 is a cross-section of the end of the discharge tube with inserted mercury source and the sealed exhaust tube.

Finally, as illustrated in FIG. 15, the evacuated discharge space 16 is sealed at the outer end 28 of the exhaust tube 20 after the insertion of the mercury source 18 into the retaining device 30. The sealing is done in a known manner, by melting the outer end 28 of the exhaust tube 20.

In the above embodiments, the mercury source 18 was an amalgam. However, the retaining device and method is also applicable if the applied mercury source is a so-called pellet, which contains liquid mercury. Such pellets are activated after the sealing of the discharge space. The carrier materials of such pellets—e.g. zinc—are known in the art. The release of the mercury from the pellet is normally activated with a short thermal pulse. With suitable adjustment of the production equipment, the thermal pulse may be delivered during the sealing of the exhaust tube.

The invention is not limited to the shown and disclosed embodiments, but other elements, improvements and variations are also within the scope of the invention. It is clear for those skilled in the art that the same principles may be applied to other types of low-pressure discharge lamps, and not only to straight light tubes such as shown in FIG. 1. For example, the proposed mercury source retaining device is applicable with all types of mercury vapour lamps

What is claimed is:

1. A device for retaining a mercury source in the discharge space of a low-pressure discharge lamp, comprising a holder comprising an inner space communicating with the discharge space and a receiver opening for receiving a mercury source, the holder includes resilient clamping means for clamping the holder in a generally tubular space segment of the discharge space, the holder further includes resilient retaining means at least partially blocking the receiver opening, the retaining means adapted for showing a passage of the mercury source in a direction towards the inner space of the holder, and blocking the movement of the mercury source through the receiver opening in a direction out of the holder.

2. The device of claim 1 in which the holder is made of a double coil, the ends of the coil being turned towards a central axis of the coil and acting as the retaining means.

3. The device of claim 1 in which the holder is made of a sheet material formed in an essentially cylindrical shape, the cylindrical holder comprises cylinder segments, the cylinder segments are separated with slits extending substantially parallel with a central axis of the cylinder, and the cylinder segments tilting radially outward and acting as the clamping means.

4. The device of claim 3 in which ends of cylinder segments folding radially inward and acting as the retaining means.

5. A device for retaining a mercury source in the discharge space of a low-pressure discharge lamp, comprising a holder comprising an inner space communicating with the discharge space, the holder further comprising a receiver opening for receiving a mercury source, resilient clamping means for clamping the holder in a generally tubular space segment of the discharge space, resilient retaining means at least partially blocking the receiver opening, the retaining means adapted for allowing a passage of the mercury source in a direction towards the inner space of the holder, and blocking the movement of the mercury source through the receiver opening in a direction out of the holder, said holder is made of a sheet material formed in an essentially cylindrical shape, said holder comprises cylinder segments, the cylinder segments are separated with slits extending substantially parallel with a central axis of the cylinder, said holder is formed as a substantially frusto-conical barrel with a longitudinal slit formed substantially along a generatrix of the barrel, and the retaining means are formed as tongues extending radially inwards from an edge of the barrel.

6. The device of claim 1 in which a material of the device is selected from the group containing stainless steel, molybdenum, tungsten or nickel.

7. A method for retaining a mercury source at a predetermined location in a discharge space of a low-pressure discharge lamp, comprising the steps of:

inserting a retaining device into the discharge space, the retaining device comprising:

an inner space communicating with the discharge space and a receiver opening for receiving a mercury source, resilient clamping means for clamping the retaining device in a generally tubular space segment of the discharge space, and resilient retaining, means at least partially blocking the receiver opening, the retaining means adapted for allowing a passage of the mercury source in a direction towards the inner space of the retaining device, and blocking the movement of the mercury source through the receiver opening in a direction out of the retaining device;

clamping the retaining device at the predetermined location; and inserting the mercury source into the retaining device through the receiver opening and past the retaining means.

8. The method of claim 7 in which the retaining device is inserted in the discharge space before evacuating the discharge space.

9. The method of claim 7 in which the retaining device is pushed into an end of an exhaust tube, in a position where the receiver opening of the retaining device turns towards an outer end of the exhaust tube.

10. The method of claim 9 in which the mercury source is pushed through the receiver opening with a pushing rod, whereby the mercury source is inserted in the retaining device.

11. The method of claim 9, in which the discharge space is filled with a filling gas, and the mercury source is blown through the receiver opening with the filling gas.

12. The method of claim 9 in which the evacuated discharge space is sealed after inserting the mercury source.

13. The method of claim 7 in which the mercury source is inserted in the retaining device after evacuating the discharge space.

14. A low-pressure discharge lamp comprising a discharge space, a discharge electrode and a mercury source located in a predetermined location of the discharge space, in which the mercury source is retained in a retaining device, the retaining device comprising a holder comprising an inner space communicating with the discharge space and a receiver opening for receiving a mercury source, resilient clamping means for clamping the holder in a tubular space segment of the discharge space, resilient retaining means at least partially blocking the receiver opening, the retaining means adapted for allowing a passage of the mercury source in a direction towards the inner space of the holder, and blocking the movement of the mercury source through the receiver opening in a direction out of the holder.

15. The discharge lamp of claim 14 in which the retaining device is frictionally retained in an end of an exhaust tube, the exhaust tube connects to a stem supporting the discharge electrode.

16. The discharge lamp of claim 14 in which the mercury source is an amalgam.

17. The discharge lamp of claim 14 in which the mercury source is a pellet containing liquid mercury.

18. A device for retaining a mercury source in a discharge space of a low-pressure discharge lamp, comprising:

a holder comprising an inner space communicating with the discharge space and a receiver opening for receiving a mercury source;

the holder includes resilient clamping members for clamping the holder in a tubular space segment of the discharge space; and the holder further includes resilient retaining members at least partially blocking the receiver opening, the retaining members adapted for allowing a passage of the mercury source in a direction towards the inner space of the holder, and blocking the movement of the mercury source through the receiver opening in a direction out of the holder.

19. A method for retaining a mercury source at a predetermined location in a discharge space of a low-pressure discharge lamp, comprising the steps of:

inserting a retaining device into the discharge space, the retaining device comprising:

an inner space communicating with the discharge space and a receiver opening for receiving a mercury source, resilient clamping members for clamping the retaining device in a tubular space segment of the discharge space, and resilient retaining members at least partially blocking the receiver opening, the retaining members adapted for allowing a passage of the mercury source in a direction towards the inner space of the retaining device, and blocking the movement of the mercury source through the receiver opening in a direction out of the retaining device;

clamping the retaining device at the predetermined location; and, inserting the mercury source into the retaining device through the receiver opening and past the retaining members.

* * * * *